US011054140B2

(12) United States Patent
Choi et al.

(10) Patent No.: US 11,054,140 B2
(45) Date of Patent: Jul. 6, 2021

(54) FUEL SUPPLY DEVICE FOR GAS TURBINE HAVING MULTIPLE PERFORATED PLATES

(71) Applicant: DOOSAN HEAVY INDUSTRIES & CONSTRUCTION CO., LTD., Changwon-si (KR)

(72) Inventors: Inchan Choi, Gwangyang-si (KR); Dongsik Han, Changwon-si (KR)

( * ) Notice: Subject to any disclaimer, the term of this patent is extended or adjusted under 35 U.S.C. 154(b) by 87 days.

(21) Appl. No.: 16/264,573

(22) Filed: Jan. 31, 2019

(65) Prior Publication Data

US 2019/0285278 A1 Sep. 19, 2019

(30) Foreign Application Priority Data

Mar. 16, 2018 (KR) ..... 10-2018-0030676

(51) Int. Cl.
*F23R 3/28* (2006.01)
*F23R 3/26* (2006.01)

(52) U.S. Cl.
CPC ..... *F23R 3/286* (2013.01); *F23R 3/26* (2013.01)

(58) Field of Classification Search
CPC .... F23R 3/286; F23R 3/26; F23R 3/12; F23R 3/16; F23R 7/002
See application file for complete search history.

(56) References Cited

U.S. PATENT DOCUMENTS 5,927,961 A * 7/1999 Robinson ..... F23K 5/04 431/207
6,438,961 B2 8/2002 Tuthill et al.
8,291,688 B2 * 10/2012 Davis, Jr. ..... F23D 14/82 60/39.091
8,312,722 B2 * 11/2012 York ..... F23R 3/283 60/737
8,959,921 B2 * 2/2015 Khan ..... F23R 3/283 60/737
9,341,375 B2 * 5/2016 Kim ..... F23R 3/10
10,344,982 B2 * 7/2019 Berry ..... F23R 3/28
2014/0190169 A1 7/2014 Melton et al.
(Continued)

FOREIGN PATENT DOCUMENTS

JP 2010-216799 A 9/2010
JP 2011-106804 A 6/2011
JP 2012-088036 A 5/2012
(Continued)

OTHER PUBLICATIONS

A Korean Office Action dated Apr. 30, 2019 in connection with Korean Patent Application No. 10-2018-0030676.

*Primary Examiner* — Todd E Manahan
*Assistant Examiner* — Todd N Jordan

(57) ABSTRACT

The present disclosure relates to a fuel supply device for gas turbines, and a fuel nozzle and gas turbine having the same. The fuel supply device of present disclosure is mounted to the fuel nozzle for a uniform flow of air introduced thereinto and for allowing uniform mixing with fuel. The present disclosure allows a uniform fuel-air mixture to be supplied to a combustion chamber. According to the present disclosure, it is possible to uniformly supply a fuel-air mixture to a combustion chamber by arranging a plurality of perforated plates in a fuel supply device for gas turbines, to suppress generation of nitrogen oxides, and to prevent flame from stagnating or flowing backward.

10 Claims, 15 Drawing Sheets

(56) References Cited

U.S. PATENT DOCUMENTS

2019/0128527 A1* 5/2019 Cho ..... F23R 3/286

FOREIGN PATENT DOCUMENTS

| | | | |
|---|---|---|---|
| KR | 10-0542900 | B1 | 3/2006 |
| KR | 2008-0065935 | A | 7/2008 |
| KR | 10-1525463 | B1 | 6/2015 |
| KR | 10-2016-0068851 | A | 6/2016 |

* cited by examiner

FUEL SUPPLY DEVICE FOR GAS TURBINE HAVING MULTIPLE PERFORATED PLATES

CROSS-REFERENCE TO RELATED APPLICATION

This application claims priority to Korean Patent Application No. 10-2018-0030676, filed on Mar. 16, 2018, the disclosure of which is incorporated herein by reference in its entirety.

BACKGROUND OF THE DISCLOSURE

Field of the Disclosure

Exemplary embodiments of the present disclosure relate to a fuel supply device for gas turbines, and a fuel nozzle and gas turbine having the same.

Description of the Related Art

Turbines are machines that obtain rotational force by impulsive or reaction force using the flow of a compressible fluid such as steam or gas, and include a steam turbine using steam, a gas turbine using hot combustion gas, and so on.

Among them, the gas turbine largely includes a compressor, a combustor, and a turbine. The compressor is provided with an air inlet for introduction of air, and includes a plurality of compressor vanes and compressor blades alternately arranged in a compressor casing.

The combustor supplies fuel to air compressed by the compressor and ignites it with a burner to produce high-temperature and high-pressure combustion gas.

The turbine includes a plurality of turbine vanes and turbine blades alternately arranged in a turbine casing. In addition, a rotor is arranged to pass through the center of the compressor, combustor, turbine and exhaust chamber.

The rotor is rotatably supported at both ends thereof by bearings. A plurality of disks is fixed to the rotor, each disk is connected with the blades, and a drive shaft of a generator is connected to the end of the exhaust chamber.

The gas turbine consumes less lubricant thanks to the absence of mutual friction parts, such as a piston-cylinder. Since it does not have a reciprocating mechanism, such as a piston in a four-stroke engine, the amplitude, which is a characteristic of the reciprocating machine, is greatly reduced, thus enabling a high-speed motion.

SUMMARY OF THE DISCLOSURE

During the operation of the gas turbine, the combustor mixes the air compressed by the compressor with fuel for combustion to generate a flow of hot combustion gas, and the hot combustion gas is injected it into the turbine to rotate the turbine for rotational force.

In this case, it is necessary to provide the combustion gas in which air and fuel are uniformly mixed for stable combustion. Particularly, if the flow of air is not uniform, there is a concern that a flame may occur in a fuel nozzle, which may lead to damage to the parts of the fuel nozzle. In addition, a non-uniform mixing of the air with fuel may increase combustion temperature or generate excessive NOx. Accordingly, there is a need to uniformly mix the fuel with air before the combustion gas is supplied to the combustion chamber.

It is an object of the present disclosure to uniformly mix fuel with air for stable premixing.

It is another object of the present disclosure to control a swirl intensity in mixing fuel with air.

It is a further object of the present disclosure to provide a uniform fuel-air mixture in a combustion chamber to stably burn fuel and reduce nitrogen oxides.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

To accomplish the above objects, in accordance with one aspect of the present disclosure, there is provided a fuel supply device for gas turbines, which includes a fuel supply pipe, a first perforated plate, a fuel injection unit, a second perforated plate, and a cover plate. Fuel flows in the fuel supply pipe. The first perforated plate is disposed around the fuel supply pipe and is formed with a plurality of openings. The fuel injection unit is spaced apart from the first perforated plate and has a plurality of fuel injection pipes connected to the fuel supply pipe while being radially arranged around the fuel supply pipe. The second perforated plate is spaced apart from the fuel injection unit around the fuel supply pipe and is formed with a plurality of openings. The cover plate has the same axis as the fuel supply pipe and extends in a longitudinal direction of the fuel supply pipe. The cover plate accommodates the first perforated plate, the fuel injection unit, and the second perforated plate therein.

In accordance with another aspect of the present disclosure, there is provided a fuel supply device for gas turbines, which includes a fuel supply pipe, a first perforated plate, a fuel injection hole, a second perforated plate, and a cover plate. Fuel flows in the fuel supply pipe. The first perforated plate is disposed around the fuel supply pipe and is formed with a plurality of openings. The fuel injection hole is formed around the fuel supply pipe at a position spaced apart from the first perforated plate. The second perforated plate is spaced apart from the fuel injection hole around the fuel supply pipe and is formed with a plurality of openings. The cover plate has the same axis as the fuel supply pipe and extends in a longitudinal direction of the fuel supply pipe. The cover plate accommodates the first perforated plate, the fuel injection unit, and the second perforated plate therein.

In the fuel supply device according to the aspects of the present disclosure, the openings of each of the first and second perforated plates may be arranged in a predetermined pattern.

The fuel supply device according to the aspects of the present disclosure may further include a third perforated plate. The third perforated plate may be spaced apart from the second perforated plate around the fuel supply pipe and be formed with a plurality of openings.

The fuel supply device according to the aspects of the present disclosure may further include a fourth perforated plate. The fourth perforated plate may be spaced apart from the first perforated plate around the fuel supply pipe and be formed with a plurality of openings.

In the fuel supply device according to the aspects of the present disclosure, each of the fuel injection pipes may be formed with at least one fuel injection hole.

In the fuel supply device according to the aspects of the present disclosure, the openings of the second perforated plate may each be inclined at a predetermined angle in a thickness direction of the second perforated plate.

In the fuel supply device according to the aspects of the present disclosure, the openings may each be inclined in a radial direction of the second perforated plate.

In the fuel supply device according to the aspects of the present disclosure, the openings may each be inclined in a tangential direction of the second perforated plate.

In the fuel supply device according to the aspects of the present disclosure, the cover plate may have a plurality of openings formed downstream thereof.

In the fuel supply device according to the aspects of the present disclosure, the openings formed downstream of the cover plate may have different diameters and be arranged in a predetermined pattern.

In accordance with still another aspect of the present disclosure, there is provided a fuel nozzle that includes a fuel nozzle center body, a shroud, a rim, and a fuel supply device for gas turbines. The fuel supply device for gas turbines includes a fuel supply pipe in which fuel flows, a first perforated plate disposed around the fuel supply pipe and formed with a plurality of openings, a fuel injection unit spaced apart from the first perforated plate and having a plurality of fuel injection pipes connected to the fuel supply pipe while being radially arranged around the fuel supply pipe, a second perforated plate spaced apart from the fuel injection unit around the fuel supply pipe and formed with a plurality of openings, and a cover plate having the same axis as the fuel supply pipe, extending in a longitudinal direction of the fuel supply pipe, and accommodating the first perforated plate, the fuel injection unit, and the second perforated plate therein.

In accordance with a further aspect of the present disclosure, there is provided a gas turbine that includes a compressor, a combustor, and a turbine. The combustor includes a combustion chamber and at least one fuel nozzle mounted in the combustion chamber. The fuel nozzle includes a fuel nozzle center body, a shroud, a rim, and a fuel supply device for gas turbines.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which.

DESCRIPTION OF SPECIFIC EMBODIMENTS

Figure 1:
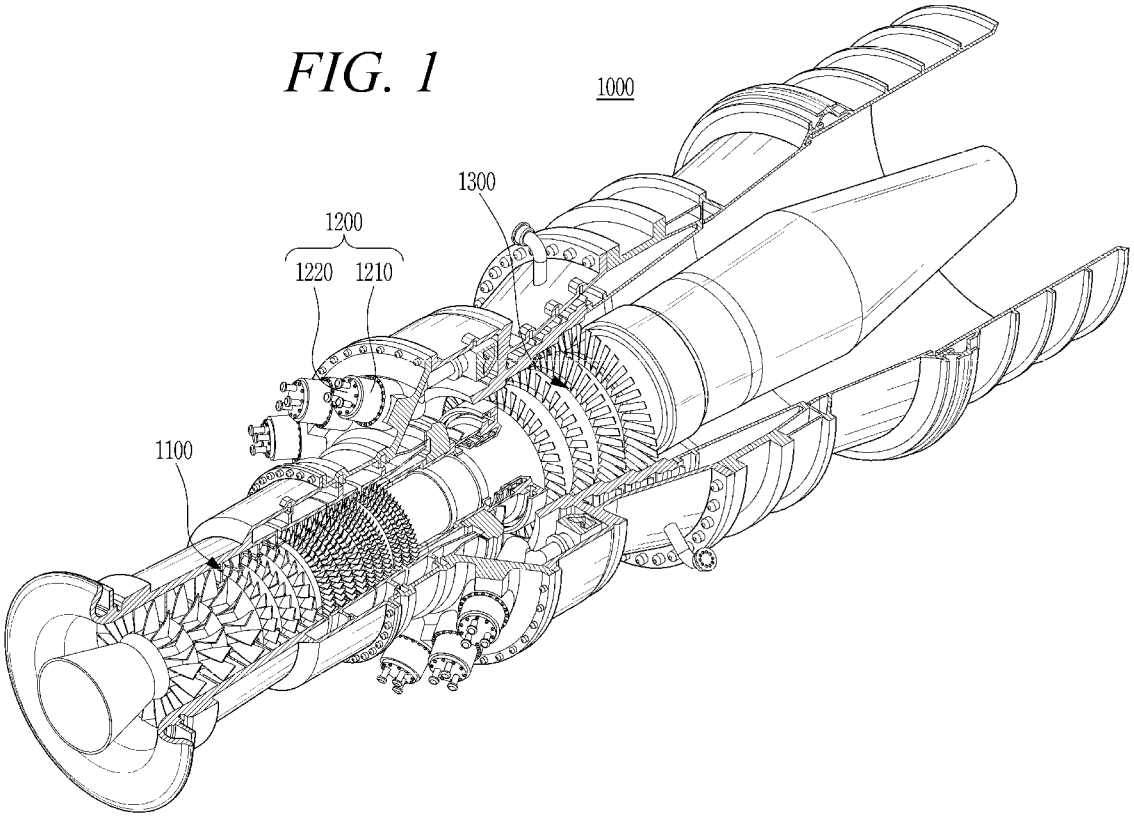
FIG. 1 is a view illustrating an overall structure of a gas turbine according to the present disclosure.

Exemplary embodiments of the present disclosure will be described below in more detail with reference to the accompanying drawings.

In certain embodiments, detailed descriptions of configurations well known by those skilled in the art will be omitted to avoid obscuring appreciation of the disclosure. Regarding the reference numerals assigned to the elements in the drawings, it should be noted that the same elements will be specified by the same reference numerals, wherever possible, even though they are illustrated in different drawings. It should be considered that the thickness of each line or the size of each component in the drawings may be exaggeratedly illustrated for clarity and convenience of description.

In addition, terms such as "first", "second", "A", "B", "(a)", and "(b)" may be used herein to describe components in the embodiments of the present disclosure. These terms are not used to define an essence, order or sequence of a corresponding component but used merely to distinguish the corresponding component from other components. It will be understood that, when an element is referred to as being "connected", "coupled", or "joined" to another element, not only can it be directly "connected", "coupled", or "joined" to the other element, but also can it be indirectly "connected", "coupled", or "joined" to the other element with other elements being interposed therebetween.

The thermodynamic cycle of a gas turbine ideally follows a Brayton cycle. The Brayton cycle consists of four phases including isentropic compression (adiabatic compression), isobaric heat addition, isentropic expansion (adiabatic expansion), and isobaric heat dissipation. In other words, in the Brayton cycle, thermal energy is released by combustion of fuel in an isobaric environment after the atmospheric air is sucked and compressed to a high pressure, hot combustion gas is expanded to be converted into kinetic energy, and exhaust gas with residual energy is then discharged to the atmosphere. The Brayton cycle consists of four processes, i.e., compression, heating, expansion, and exhaust.

The gas turbine using the above Brayton cycle includes a compressor, a combustor, and a turbine. FIG. 1 is a view schematically illustrating an overall configuration of a gas turbine 1000. Although the following description is given with reference to FIG. 1, the present disclosure may be widely applied to a gas turbine having the same configuration as the gas turbine 1000 exemplarily illustrated in FIG. 1.

A compressor 1100 of the gas turbine 1000 serves to suck and compress air, and mainly serves to supply cooling air to a high-temperature region required for cooling in the gas turbine 1000 while supplying combustion air to a combustor 1200. Since the air sucked into the compressor 1100 is subject to an adiabatic compression process therein, the pressure and temperature of the air passing through the compressor 1100 increase.

The compressor 1100 included in the gas turbine 1000 is typically designed as a centrifugal compressor or an axial compressor. In general, the centrifugal compressor is applied to a small gas turbine, whereas a multistage axial compressor, such as the compressor 1100, is applied to the large gas turbine 1000 illustrated in FIG. 1 because the multistage axial compressor is necessary to compress a large amount of air.

The compressor 1100 is actuated by some of the power output from a turbine 1300. To this end, the rotary shaft of the compressor 1100 is directly connected to the rotary shaft of the turbine 1300, as illustrated in FIG. 1. In the large gas turbine 1000, the compressor 1100 requires about half of the power generated in the turbine 1300 to be actuated. Accordingly, improving the efficiency of the compressor 1100 has a direct influence in the overall efficiency of the gas turbine 1000.

Figure 2:
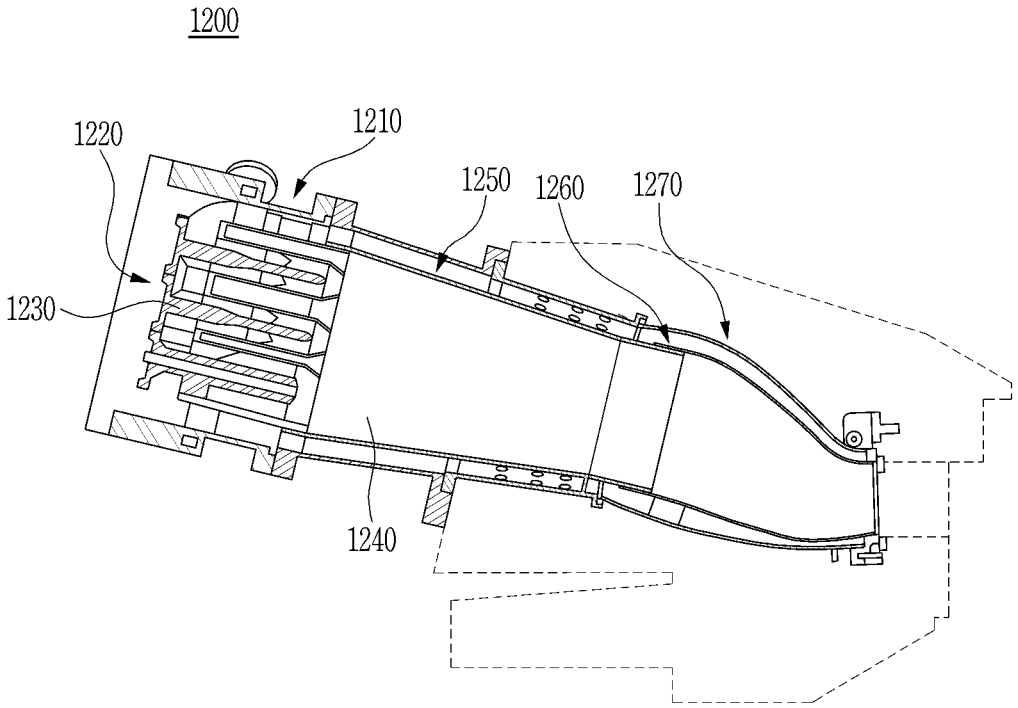
FIG. 2 is a view illustrating a combustor of the gas turbine according to the present disclosure.

The combustor 1200 mixes the compressed air, which is supplied from the outlet of the compressor 1100, with fuel for isobaric combustion to produce high-energy combustion gas. FIG. 2 illustrates an example of the combustor 1200 included in the gas turbine 1000. The combustor 1200 is disposed downstream of the compressor 1100 and includes a plurality of burners 1220 arranged along an annular combustor cover plate 1210. Each of the burners 1220 includes a plurality of combustion nozzles 1230, and the fuel injected from the combustion nozzles 1230 is mixed with air at an appropriate rate to be suitable for combustion.

The gas turbine 1000 may use gas fuel, liquid fuel, or composite fuel combining them. For the gas turbine 1000, it is important to make a combustion environment for reducing an amount of emission such as carbon monoxide or nitrogen oxide that is subject to legal regulations. Accordingly, premixed combustion has been increasingly used in recent years in that it can accomplish uniform combustion to reduce emission by lowering a combustion temperature even though it is relatively difficult to control combustion. In the premixed combustion, compressed air is mixed with the fuel injected from the combustion nozzles 1230 and then is introduced into a combustion chamber 1240. When combustion is stable after premixed gas is initially ignited by an igniter, the combustion is maintained by the supply of fuel and air.

The combustor 1200 should be suitably cooled since it operates at the highest temperature in the gas turbine 1000. Referring to FIG. 2, compressed air flows along the outer surface of a duct assembly, which connects the burner 1220 to the turbine 1300 so that hot combustion gas flows through the duct assembly. The duct assembly includes a liner 1250, a transition piece 1260, and a flow sleeve 1270, and is supplied to the combustion nozzles 1230. In this process, the duct assembly heated by the hot combustion gas is properly cooled.

The duct assembly has a double structure in which the flow sleeve 1270 surrounds the liner 1250 and the transition piece 1260 interconnected through an elastic support means. The liner 1250 and the transition piece 1260 are cooled by the compressed air permeated into the annular space inside the flow sleeve 1270.

Since the respective ends of the liner 1250 and the transition piece 1260 are fixed to the combustor 1200 and the turbine 1300, the elastic support means may be a structure that is capable of accommodating length and/or diameter elongation due to thermal expansion to support the liner 1250 and the transition piece 1260.

The high-temperature and high-pressure combustion gas produced in the combustor 1200 is supplied to the turbine 1300 through the duct assembly. In the turbine 1300, the thermal energy of combustion gas is converted into mechanical energy to rotate the rotary shaft of the turbine 1300 by applying impingement and reaction force to a plurality of blades radially arranged on the rotary shaft of the turbine 1300 through the adiabatic expansion of the combustion gas. Some of the mechanical energy obtained from the turbine 1300 is supplied as energy required for compression of air in the compressor, and the remainder is used as effective energy for driving a generator to produce electric power or the like.

The gas turbine 1000 is advantageous in that consumption of lubricant is extremely low due to the absence of mutual friction parts, such as a piston-cylinder. Since the gas turbine 1000 does not have main reciprocating components, the amplitude, which is a characteristic of reciprocating machines, is greatly reduced, thus enabling its high-speed motion.

The thermal efficiency in the Brayton cycle is increased as a compression ratio related to compression of air becomes high and the temperature of combustion gas (e.g., turbine inlet temperature) introduced in the isentropic expansion process becomes high. Therefore, the gas turbine 1000 is also progressing in a direction of increasing the compression ratio and the temperature at the inlet of the turbine.

Figure 3:
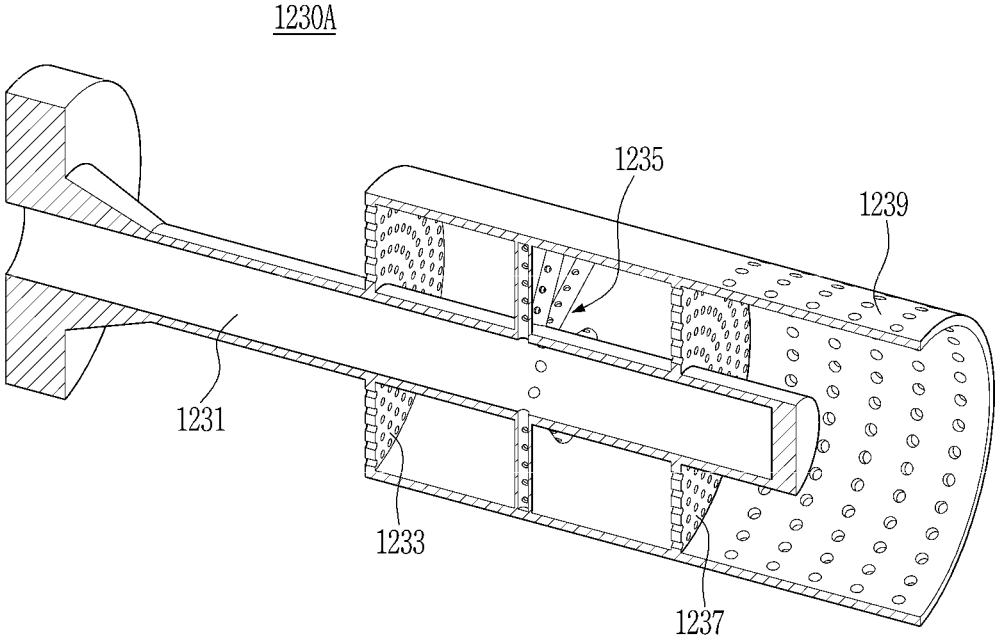
FIG. 3 is a view illustrating a fuel supply device for gas turbines according to an embodiment of the present disclosure.
Figure 4:
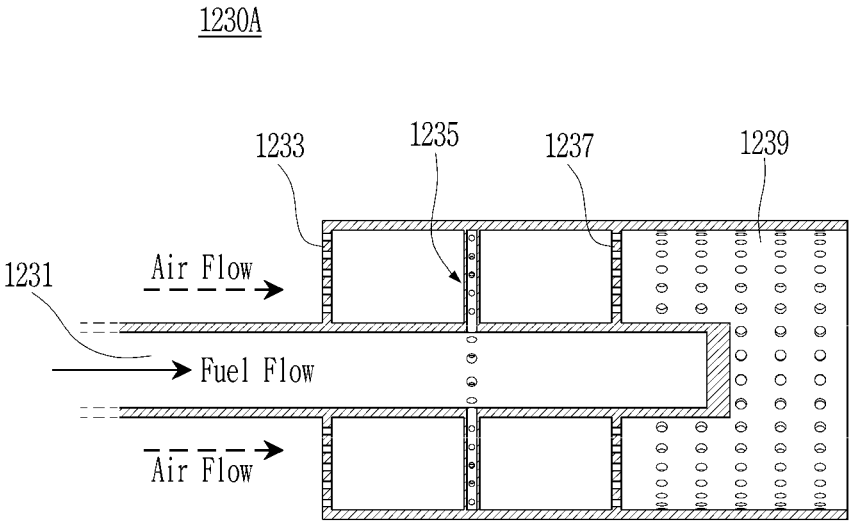
FIG. 4 is a longitudinal cross-sectional view illustrating the fuel supply device for gas turbines according to the embodiment of the present disclosure.

FIG. 3 is a view illustrating a fuel supply device for gas turbines 1230A according to an embodiment of the present disclosure. FIG. 4 is a longitudinal cross-sectional view illustrating the fuel supply device for gas turbines 1230A according to the embodiment of the present disclosure.

The present disclosure relates to the fuel supply device for gas turbines 1230A, as a device for premixed combustion, which is capable of controlling a swirl intensity and a flow of air. The fuel supply device 1230A may reduce generation of NOx by uniformly mixing air with fuel, and stabilize flame.

As illustrated in FIG. 3, the fuel supply device for gas turbines 1230A according to the present disclosure includes a fuel supply pipe 1231, a first perforated plate 1233, a fuel injection unit 1235, a second perforated plate 1237, and a cover plate 1239. The fuel supply pipe 1231 is connected to a fuel tank (not shown) to be supplied with fuel therefrom. The fuel supplied to the fuel supply pipe 1231 flows therein.

The first perforated plate 1233 is positioned in one region of the fuel supply pipe 1231. The first perforated plate 1233 has a disk shape and has the same axis as the fuel supply pipe 1231.

The fuel injection unit 1235 is spaced apart from the first perforated plate 1233 around the fuel supply pipe 1231. The fuel injection unit 1235 includes a plurality of fuel injection pipes 1236 (See FIG. 7). Each of the fuel injection pipes 1236 is supplied with fuel from the fuel supply pipe 1231 in such a manner that the internal flow channel of the fuel injection pipe 1236 is connected to the fuel supply pipe 1231.

The fuel injection pipes 1236 are radially arranged around the fuel supply pipe 1231. Each of the fuel injection pipes 1236 is cylindrical having a smaller diameter than the fuel supply pipe 1231. The internal flow channel of the fuel injection pipe may be connected to the fuel supply pipe 1231 by fixedly positioning one surface of the fuel injection pipe thereto. Since the fuel injection pipe 1236 is cylindrical, it is possible to minimize an influence on the flow of air. The flowing air begins to mix with the fuel injected from fuel injection pipe 1236 while passing the surface thereof. The fuel injection pipe 1236 has the flow channel defined therein, and the fuel flowing in the fuel supply pipe 1231 is introduced into the flow channel of the fuel injection pipe 1236.

The second perforated plate 1237 is disposed to surround a portion of the fuel supply pipe 1231. Similar to the first perforated plate 1233, the second perforated plate 1237 has a disk shape and has the same axis as the fuel supply pipe 1231. The second perforated plate 1237 is spaced apart from the fuel injection unit 1235.

The cover plate 1239 has the same axis as the fuel supply pipe 1231 and has a cylindrical shape. The cover plate 1239 extends in the longitudinal direction of the fuel supply pipe 1231 in parallel therewith. The cover plate 1239 accommodates the first perforated plate 1233, the fuel injection unit 1235, and the second perforated plate 1237 therein.

As illustrated in FIG. 4, in the fuel supply device for gas turbines 1230A according to the present disclosure, fuel flows in the fuel supply pipe 1231 and air flows outside the fuel supply pipe 1231. The flowing air passes through the first perforated plate 1233 to mix with the fuel injected from the fuel injection unit 1235. Here, a mixing chamber for mixing air with fuel is defined by the first and second perforated plates 1233 and 1237 and the cover plate 1239. As a fuel-air mixture mixed in the mixing chamber passes through the second perforated plate 1237, the uniformity thereof is further increased.

The fuel supply device for gas turbines 1230A is mounted in a fuel nozzle 1230 to regulate the flow of air and uniformly mix air with fuel.

Figure 5:
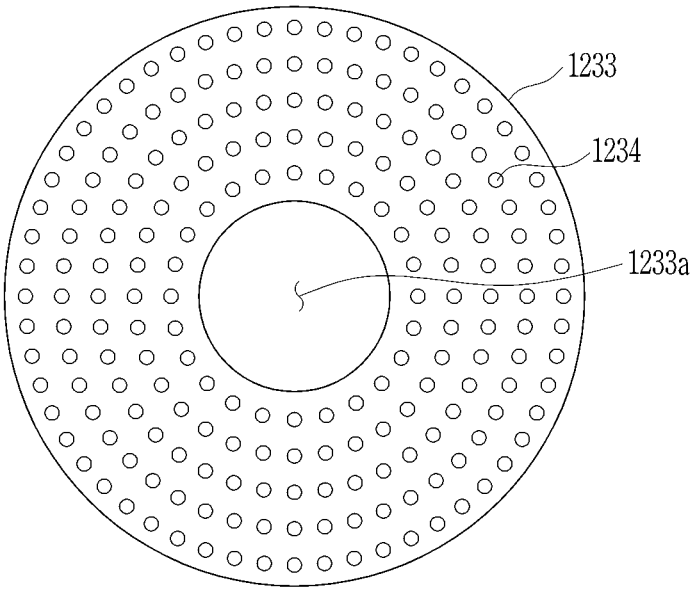
FIG. 5 is a view illustrating a first perforated plate in the fuel supply device for gas turbines according to the embodiment of the present disclosure.

FIG. 5 is a view illustrating the first perforated plate in the fuel supply device for gas turbines 1230A according to the embodiment of the present disclosure. FIG. 6 is a view illustrating another example of a first perforated plate in the fuel supply device for gas turbines 1230A according to the embodiment of the present disclosure.

The fuel supply device for gas turbines 1230A according to the embodiment of the present disclosure will be described in more detail.

The first perforated plate 1233 is mounted around the fuel supply pipe 1231. As illustrated in FIG. 5, the first perforated plate 1233 has a disk shape. The first perforated plate 1233 has a coupling hole 1233*a* formed at the center thereof for coupling with the fuel supply pipe 1231.

The first perforated plate 1233 has openings 1234 formed through the thickness thereof. As the openings 1234 having the same diameter are arranged in a predetermined pattern, it is possible to uniformly supply air into the fuel supply device for gas turbines 1230A.

The air introduced into the fuel nozzle passes through the openings 1234 of the first perforated plate 1233. The first perforated plate 1233 may regulate the flow of introduced air. For example, it is possible to realize a desired flow by adjusting the shapes and sizes of the openings 1234 of the first perforated plate 1233.

Meanwhile, the thickness of the first perforated plate 1233 may be adjusted according to the desired design concept. As the thickness of the first perforated plate 1233 is increased, the time for the flowing air to pass through the openings 1234 of the first perforated plate 1233 may take longer and the pressure of the air may be reduced.

Figure 6A:
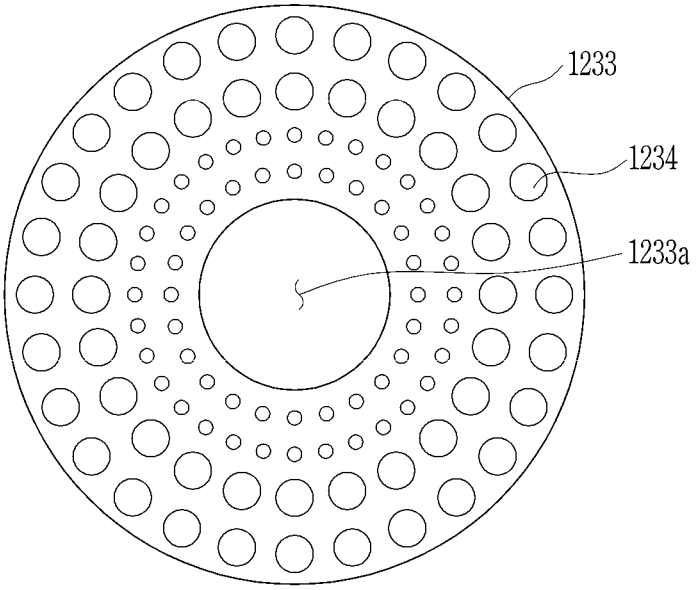
FIGS. 6A and 6B are views illustrating another example of a first perforated plate in the fuel supply device for gas turbines according to the embodiment of the present disclosure.

The plurality of openings 1234 may be arranged in a consistent pattern. In an embodiment, the openings 1234 may have two different diameters. As illustrated in FIG. 6A, openings with a smaller diameter may be arranged at the center side of the first perforated plate 1233, and openings with a larger diameter may be arranged radially outward therefrom. The flow of air radially inward of the fuel nozzle 1230 may be made different from that radially outward thereof by increasing the areas of the openings 1234 arranged outward from the center of the first perforated plate 1233. When the openings 1234 arranged radially outward in the first perforated plate 1233 are formed to be larger, the flow of air radially outward of the fuel nozzle can be relatively faster.

Figure 6B:
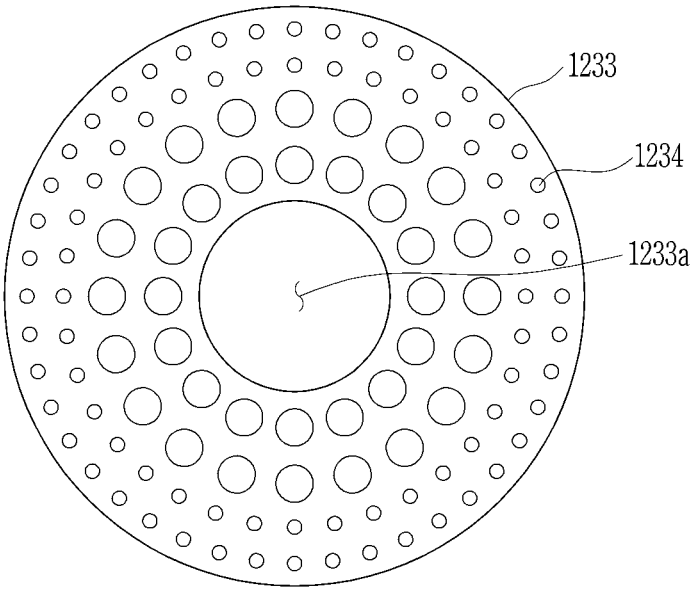

On the other hand, as illustrated in FIG. 6B, openings with a larger diameter may be arranged at the center side of the first perforated plate 1233, and openings with a smaller diameter may be arranged radially outward therefrom. When the openings 1234 arranged at the center side of the first perforated plate 1233 are formed to have a large area, the flow of air radially inward of the fuel nozzle 1230 can be relatively fast. The flow of air can be regulated by adjusting the shape and area of the openings in the first perforated plate 1233. Although the first perforated plate 1233 has been exemplified as having two types of openings different in diameter in the present embodiment, the present disclosure is not limited thereto. For example, various sized and shaped openings 1234 may also be arranged.

The first perforated plate 1233 may be detachably mounted on the fuel supply pipe 1231 so as to be replaceable according to the design of the combustor.

Although only the first perforated plate 1233 has been described in the present embodiment, the same technique may be applied to the second perforated plate 1237 as well.

Figure 7:
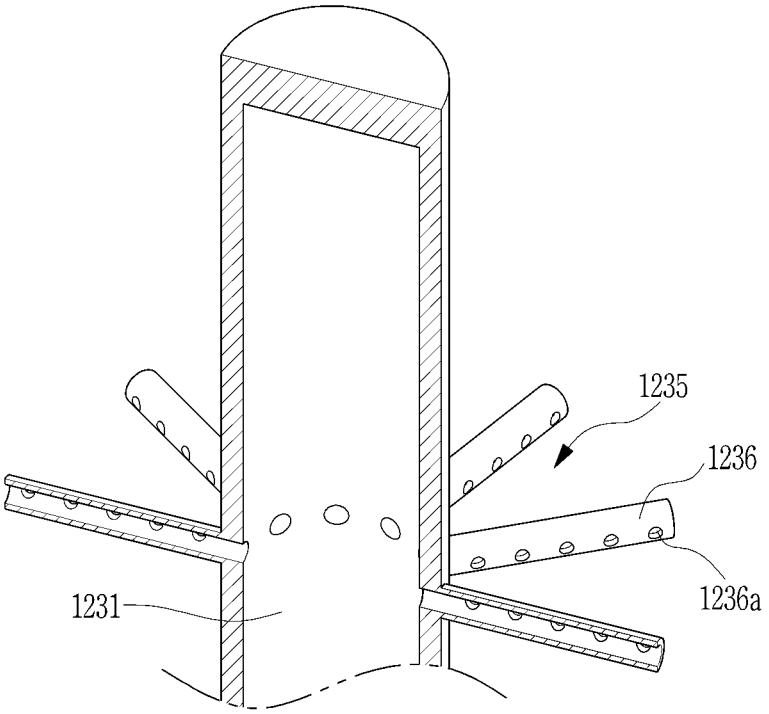
FIG. 7 is a view illustrating a fuel injection unit in the fuel supply device for gas turbines according to the embodiment of the present disclosure.
Figure 8:
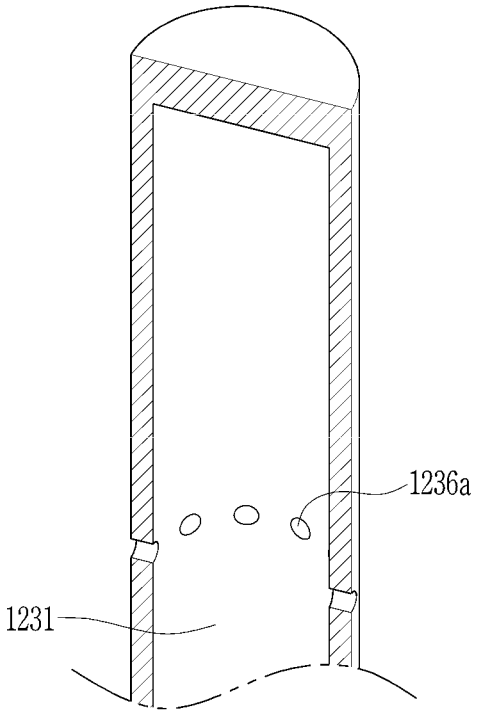
FIG. 8 is a view illustrating fuel injection holes formed in a fuel supply pipe in the fuel supply device for gas turbines according to the embodiment of the present disclosure.

FIG. 7 is a view illustrating the fuel injection unit in the fuel supply device for gas turbines according to the embodiment of the present disclosure. FIG. 8 is a view illustrating fuel injection holes formed in the fuel supply pipe in the fuel supply device for gas turbines according to the embodiment of the present disclosure.

The fuel injection unit 1235 is spaced apart from the first perforated plate 1233 around the fuel supply pipe 1231. As illustrated in FIG. 7, the fuel injection unit 1235 includes the plurality of fuel injection pipes 1236. The fuel injection pipes 1236 are radially arranged around the fuel supply pipe 1231, and the inner portions of the fuel injection pipes 1236 are connected to the inner portion of the fuel supply pipe 1231.

Each of the fuel injection pipes 1236 has a cylindrical shape. The air flowing in the fuel nozzle flows past the curved outer surfaces of the fuel injection pipes 1236.

Each of the fuel injection pipes 1236 has a fuel injection hole 1236*a* formed on the side thereof. The fuel injection hole 1236*a* comprises a plurality of fuel injection holes 1236*a*. The fuel injection holes 1236*a* may be spaced at regular intervals. The fuel injection pipe 1236 has a flow channel defined therein, and the fuel flowing in the fuel supply pipe 1231 flows into the flow channel in the fuel injection pipe 1236 to be injected from the fuel injection holes 1236*a*. The fuel is injected in a direction perpendicular to the fuel injection pipe 1236, namely in a circumferential direction of the fuel nozzle. Since the fuel injection holes 1236*a* are spaced at regular intervals in the radial direction of the fuel nozzle, the fuel injected from the fuel injection pipe 1236 can be mixed with flowing air at a more uniform density. Although the fuel injection holes 1236*a* are spaced at the same distance with each other in the present embodiment, the present disclosure is not limited thereto. The fuel injection holes may be designed to be spaced at different intervals as necessary.

In another example, the fuel injection unit 1235 does not include the fuel injection pipes 1236, but the fuel injection holes 1236*a* may be directly formed on the fuel supply pipe 1231. As illustrated in FIG. 8, the fuel injection holes 1236*a* may be formed in the fuel supply pipe 1231. In this case, the fuel flowing in the fuel supply pipe 1231 is injected in the radial direction of the fuel nozzle through the fuel injection holes 1236*a*.

Figure 9A:
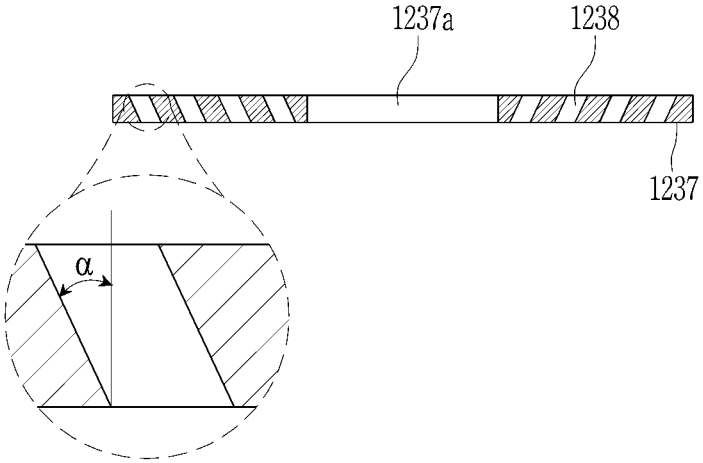
FIGS. 9A and 9B are views illustrating a second perforated plate in the fuel supply device for gas turbines according to the embodiment of the present disclosure.
Figure 9B:
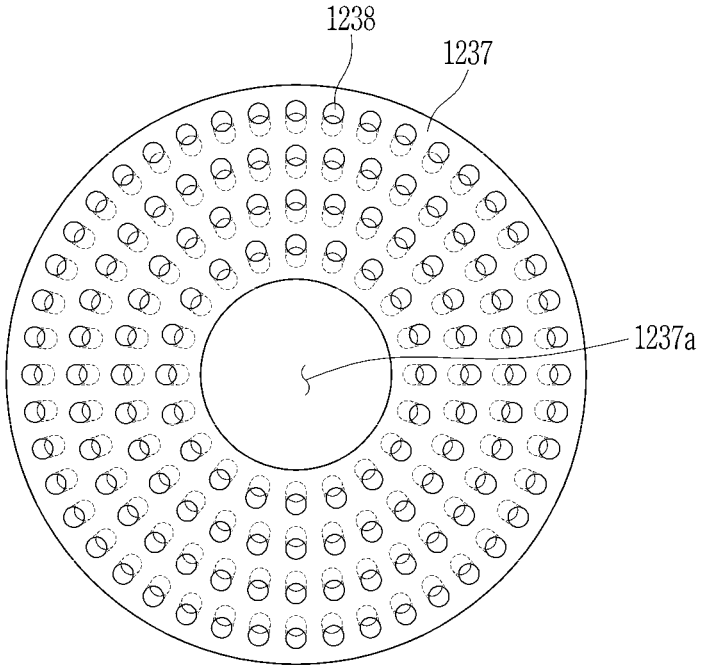
Figure 10A:
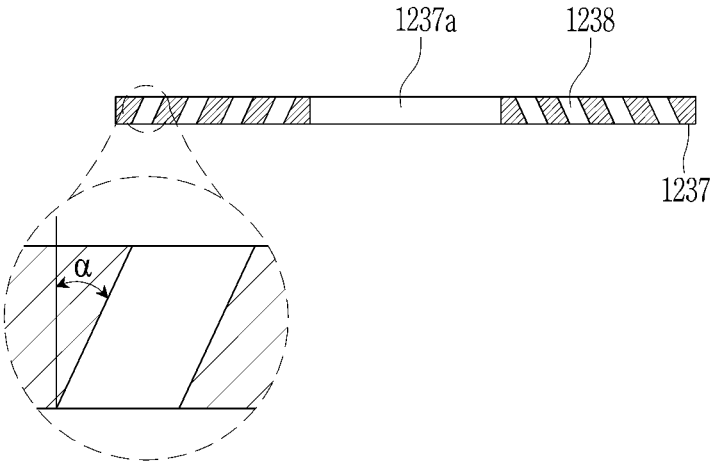
FIGS. 10A and 10B are views illustrating another example of a second perforated plate in the fuel supply device for gas turbines according to the embodiment of the present disclosure.
Figure 10B:
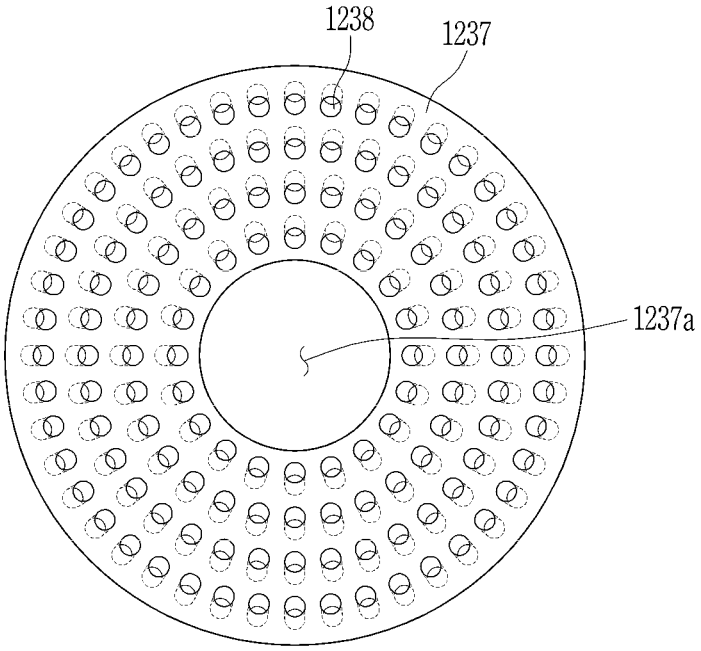
Figure 11:
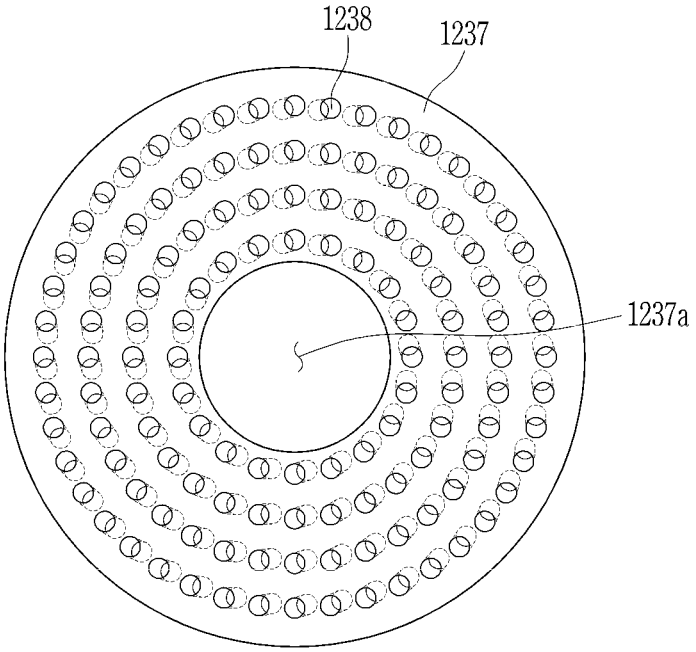
FIG. 11 is a view illustrating a further example of a second perforated plate in the fuel supply device for gas turbines according to the embodiment of the present disclosure.

FIGS. 9A and 9B are views illustrating the second perforated plate 1237 in the fuel supply device for gas turbines 1230A according to the embodiment of the present disclosure. FIGS. 10A and 10B are views illustrating another example of the second perforated plate in the fuel supply device for gas turbines 1230A according to the embodiment of the present disclosure. FIG. 11 is a view illustrating a further example of the second perforated plate 1237 in the fuel supply device for gas turbines 1230A according to the embodiment of the present disclosure.

The second perforated plate 1237 has a disk shape in which a coupling hole 1237*a* is formed at the center thereof. The second perforated plate 1237 is coupled to the fuel supply pipe 1231 through the coupling hole 1237*a*.

The second perforated plate 1237 has openings 1238 formed through the thickness thereof. As illustrated in FIGS. 9A and 9B, each of the openings 1238 of the second perforated plate 1237 may be inclined by $\alpha°$ with respect to the thickness direction of the second perforated plate 1237. The air that has passed through the first perforated plate 1233 is mixed with fuel through the fuel injection unit 1235. The space between the fuel injection unit 1235 and the second perforated plate 1237 serves as a mixing chamber for mixing air with fuel. The air mixed with the fuel passes through the second perforated plate 1237. When the opening 1238 of the second perforated plate 1237 is inclined, the flow of the fuel-air mixture passing through the second perforated plate 1237 is regulated in the direction of inclination of the opening 1238. When the opening 1238 of the second perforated plate 1237 is inclined radially outward of the second perforated plate 1237, the air that has passed through the second perforated plate 1237 flows radially outward. The fuel-air mixture flowing radially outward may impinge on the cover plate 1239 to form a partial swirl. The a value may be adjusted according to the desired design.

On the other hand, as illustrated in FIGS. 10A and 10B, the opening 1238 of the second perforated plate 1237 may also be inclined radially inward of the second perforated plate 1237. In this case, the air that has passed through the second perforated plate 1237 flow radially inward. The fuel-air mixture flowing radially inward of the second perforated plate 1237 flows to the center of the fuel nozzle to make the overall density of the fuel-air mixture in the fuel nozzle uniform.

In a further example, the opening 1238 of the second perforated plate 1237 may be inclined in the normal direction of the outer periphery of the second perforated plate 1237. FIG. 11 illustrates that each opening 1238 of the second perforated plate 1237 is inclined in the normal direction of the outer periphery of the second perforated plate 1237. In this case, the fuel-air mixture that has passed through the second perforated plate 1237 is induced to flow parallel to the circumferential direction of the second perforated plate 1237, so that the swirl intensity of the fuel-air mixture can be increased. The inclination value may be adjusted according to the desired swirl intensity. In addition, the direction of inclination may be selected either clockwise or counterclockwise.

Although the second perforated plate 1237 has been described in the present embodiment, each of the openings 1234 of the first perforated plate 1233 may also be inclined radially outward or inward of the first perforated plate 1233 or in the normal direction of the first perforated plate 1233 as each occasion demands.

The present disclosure may form a swirl flow by the second perforated plate 1237 and prevent the backflow of flame by inducing uniform mixing of air with fuel.

The second perforated plate 1237 may be detachably mounted to the fuel supply pipe 1231 so as to be replaceable according to the design of the combustor.

Meanwhile, the end of the fuel supply pipe 1231 is positioned past the point where the second perforated plate 1237 is disposed. The end of the fuel supply pipe 1231 has a disk shape, and it is thus possible to enhance stabilizing the flame.

Figure 12A:
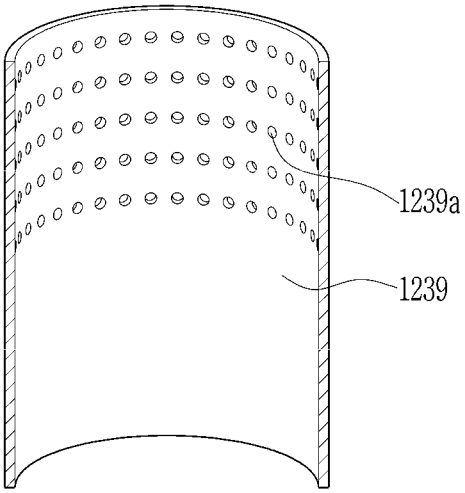
FIGS. 12A and 12B are cross-sectional views illustrating a cover plate in the fuel supply device for gas turbines according to the embodiment of the present disclosure.
Figure 12B:
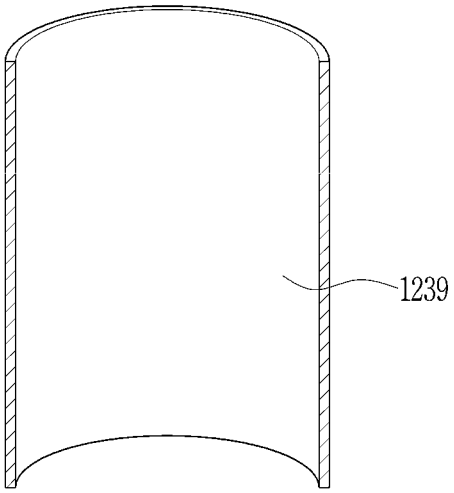

FIGS. 12A and 12B are cross-sectional views illustrating the cover plate 1239 in the fuel supply device for gas turbines 1230A according to the embodiment of the present disclosure.

As illustrated in FIGS. 12A and 12B, the cover plate 1239 has a cylindrical shape. The cover plate 1239 surrounds the outer peripheries of the first and second perforated plates 1233 and 1237 and the end of the fuel injection unit 1235, and accommodates the first and second perforated plates 1233 and 1237 and the fuel injection unit 1235 therein. The cover plate 1239 has the same axis as the fuel supply pipe 1231, and extends parallel to the fuel supply pipe 1231. The upstream end of the cover plate 1239 is coupled to the outer periphery of the first perforated plate 1233. The cover plate 1239 is coupled to the first perforated plate 1233 so that the upstream end of the cover plate 1239 is closed and the downstream end thereof is opened. As illustrated in FIG. 12A, the cover plate 1239 may have openings 1239*a* formed downstream thereof. Outside air is introduced into the fuel supply device for gas turbines 1230A by the openings 1239*a* formed on the cover plate 1239. Thus, it is possible to impart a swirl to the fuel-air mixture by the openings 1239*a* formed on the cover plate 1239, and to compensate the pressure loss of the fuel nozzle by the openings 1239*a* formed downstream of the cover plate 1239.

On the other hand, as illustrated in FIG. 12B, no opening is formed on the cover plate 1239 and an additional swirl may not be imparted to the fuel-air mixture.

Figure 13A:
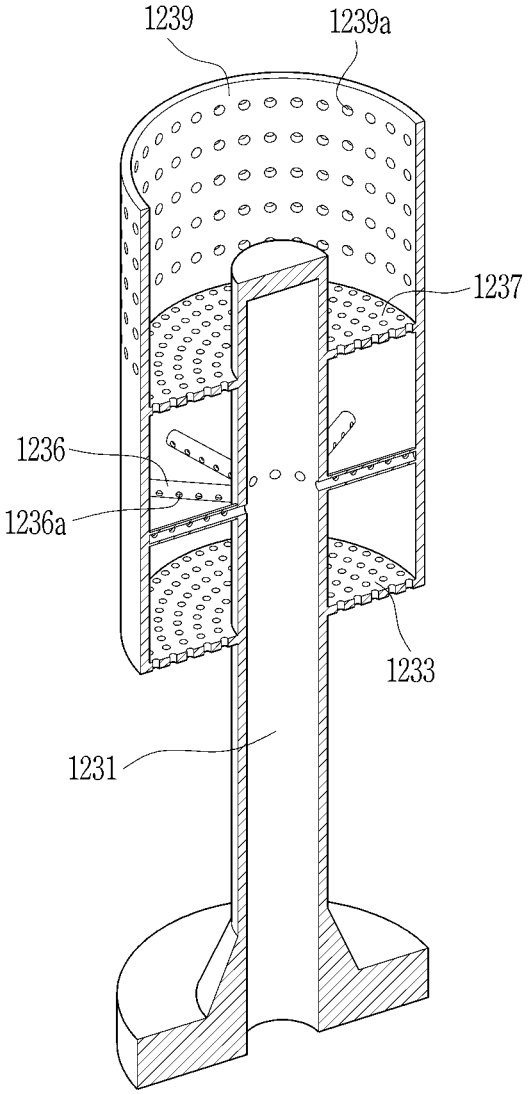
FIGS. 13A and 13B are views illustrating a fuel supply device for gas turbines according to an embodiment of the present disclosure.
Figure 13B:
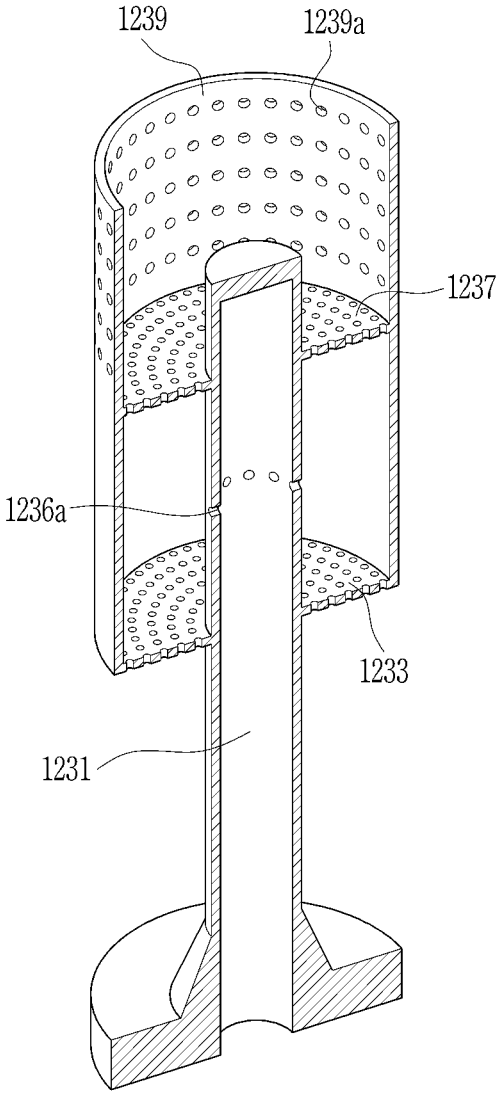
Figure 14A:
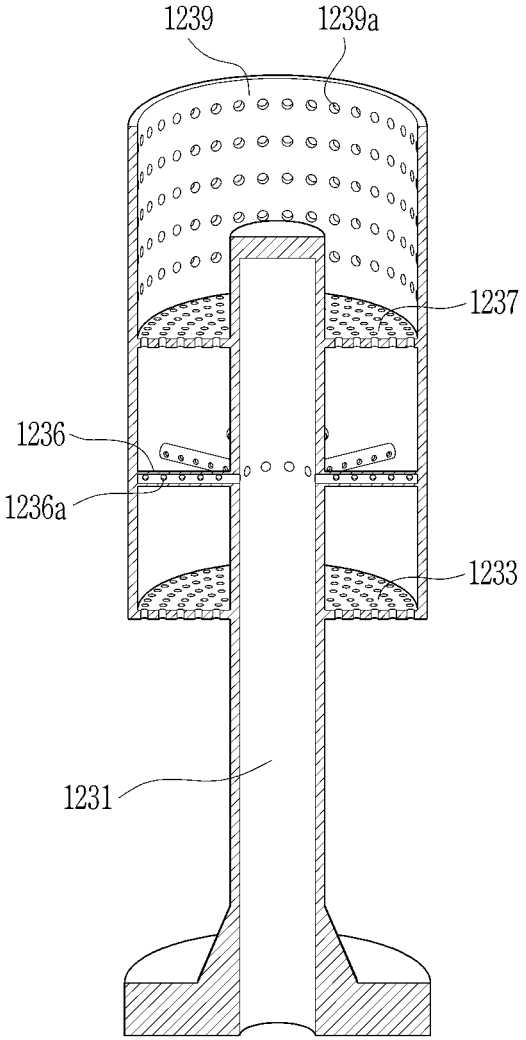
FIGS. 14A and 14B are views illustrating the fuel supply device for gas turbines according to the embodiment of the present disclosure.
Figure 14B:
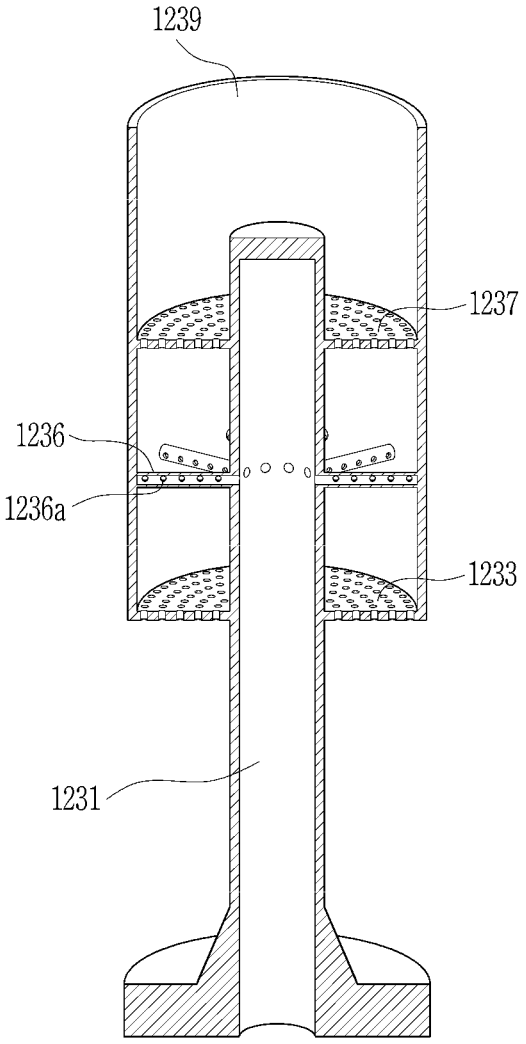
Figure 15A:
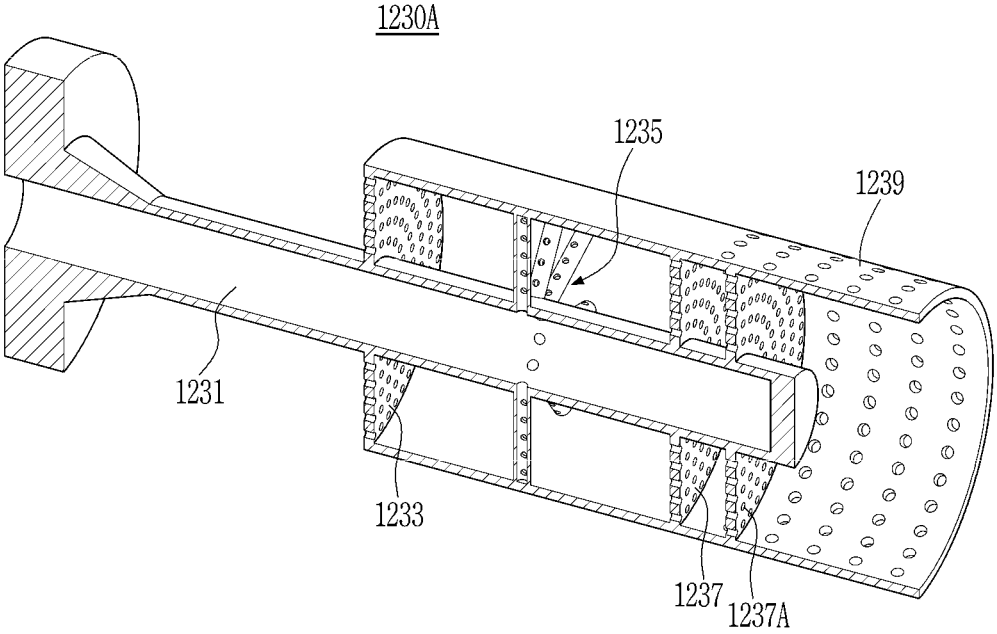
FIGS. 15A and 15B are views illustrating a fuel supply device for gas turbines according to another embodiment of the present disclosure.
Figure 15B:
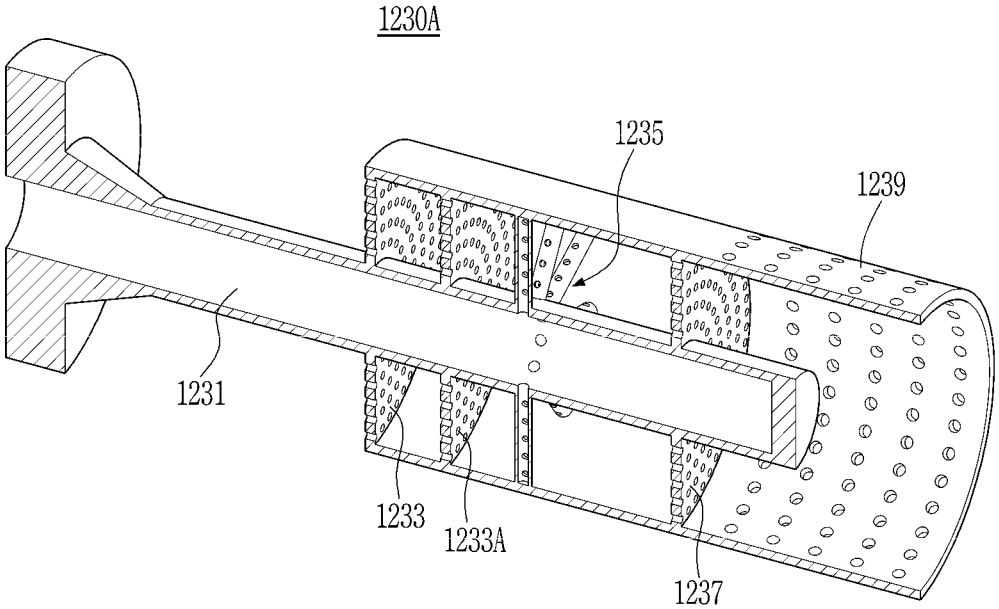

FIGS. 13A and 13B are views illustrating a fuel supply device for gas turbines 1230A according to an embodiment of the present disclosure. FIGS. 14A and 14B are views illustrating the fuel supply device for gas turbines 1230A according to the embodiment of the present disclosure. FIGS. 15A and 15B are views illustrating a fuel supply device for gas turbines according to another embodiment of the present disclosure.

The fuel supply device for gas turbines 1230A according to the present disclosure will be described with reference to various embodiments.

The fuel supply device for gas turbines 1230A according to the present disclosure includes the fuel supply pipe 1231, the first perforated plate 1233, the fuel injection unit 1235, the second perforated plate 1237, and the cover plate 1239. The first perforated plate 1233, the fuel injection unit 1235, and the second perforated plate 1237 are spaced apart from each other by a predetermined distance around the fuel supply pipe 1231. The first perforated plate 1233, the fuel injection unit 1235, and the second perforated plate 1237 are accommodated in the cover plate 1239.

In the fuel supply device for gas turbines 1230A, a mixing chamber for mixing air with fuel is defined by the first and second perforated plates 1233 and 1237. The fuel injection unit 1235 is positioned in the mixing chamber. The air introduced through the first perforated plate 1233 is mixed with the fuel injected from the fuel injection unit 1235 in the mixing chamber. The fuel injection unit 1235 illustrated in FIG. 13A includes the plurality of fuel injection pipes 1236. Each of the fuel injection pipes 1236 has the plurality of fuel injection holes 1236*a* spaced at a predetermined interval on the side thereof. The fuel injection pipe 1236 has a flow channel defined therein so that the fuel introduced from the fuel supply pipe 1231 is injected through the fuel injection holes 1236*a*. The fuel is injected in a direction perpendicular to the fuel injection pipe 1236, namely in a circumferential direction of the fuel supply device for gas turbines 1230A. The fuel injected from the fuel injection holes 1236*a* is uniformly mixed in the mixing chamber with the air introduced thereinto. The fuel-air mixture is mixed more uniformly while passing through the second perforated plate 1237. The cover plate 1239 has openings 1239*a* formed downstream thereof beyond the second perforated plate 1237. A swirl can be imparted to the fuel-air mixture by introducing air through the openings 1239*a* formed downstream of the cover plate 1239, and it is thus possible to achieve more uniform premixing.

The fuel injection unit 1235 does not include the plurality of fuel injection pipes 1236, but the fuel injection holes 1236*a* may be formed in the fuel supply pipe 1231. As illustrated in FIG. 13B, the fuel injection holes 1236*a* are formed in the fuel supply pipe 1231 so that the fuel is injected in a direction perpendicular to the fuel supply pipe 1231, namely radially outward of the fuel supply device for gas turbines 1230A. The fuel injected from the fuel injection holes 1236*a* is uniformly mixed in the mixing chamber with the air introduced thereinto. The uniformity of the fuel-air mixture is further increased while the fuel-air mixture passes through the second perforated plate 1237.

Meanwhile, the fuel supply device for gas turbines 1230A according to the present disclosure can impart an additional swirl to the fuel-air mixture. As illustrated in FIG. 14A, when the cover plate 1239 has openings 1239*a* formed downstream thereof, outside air may be introduced into the cover plate to impart a swirl to the fuel-air mixture. On the other hand, when there is no need to impart an additional swirl, no opening is formed in the cover plate, in which case the fuel-air mixture may be consistently mixed while flowing in the space defined by the second perforated plate 1237 and the cover plate 1239. The fuel-air mixture that has passed through the fuel supply device for gas turbines 1230A is supplied to the combustion chamber.

Although the above embodiment has been described as having two perforated plates, the present disclosure is not limited thereto. For example, two or more perforated plates may be provided. As illustrated in FIGS. 15A and 15B, the fuel supply device for gas turbines 1230A according to the present disclosure may include three perforated plates. The fuel supply device for gas turbines 1230A illustrated in FIG. 15A includes the fuel supply pipe 1231, the first perforated plate 1233, the fuel injection unit 1235, the second perforated plate 1237, a third perforated plate 1237A, and the cover plate 1239. The third perforated plate 1237A is spaced apart from the second perforated plate 1237 and is positioned downstream of the cover plate 1239. The uniformity of the fuel-air mixture mixed in the mixing chamber is further increased while the fuel-air mixture passes through the second and third perforated plates 1237 and 1237A.

The fuel supply device for gas turbines illustrated in FIG. 15B includes the fuel supply pipe 1231, the first perforated plate 1233, a fourth perforated plate 1233A, the fuel injection unit 1235, the second perforated plate 1237, and the cover plate 1239. The fourth perforated plate 1233A is spaced apart from the first perforated plate 1233 between the first perforated plate 1233 and the fuel injection unit 1235. The air introduced into the fuel supply device for gas turbines 1230A sequentially passes through the first and fourth perforated plates 1233 and 1233A and is supplied to the mixing chamber in a uniform flow.

A plurality of perforated plates may be installed by adjusting the arrangement order thereof according to the desired design.

Although the above embodiment has been described as using gas as fuel, the present disclosure is not limited thereto. The present disclosure is usable as a device mounted to a liquid fuel nozzle for supply of liquid fuel.

The present disclosure can achieve uniform premixing by a plurality of perforated plates, suppress the generation of nitrogen oxides during combustion by uniformly mixing air with fuel, and reduce the backflow of flame and an occurrence of vibration.

As is apparent from the above description, in accordance with the present disclosure, it is possible to uniformly mix fuel with air by the stable flow of introduced air and to achieve stable premixing.

In accordance with the present disclosure, it is possible to reduce nitrogen oxides and combustion vibration by stably burning fuel.

In accordance with the present disclosure, it is possible to control a swirl intensity according to the required design.

The embodiments disclosed in the present specification and drawings are only illustrative of the present disclosure for the purpose of facilitating the explanation and understanding of the present disclosure, and are not intended to limit the scope of the present disclosure. It will be apparent to those skilled in the art that other modifications based on the technical idea of the present disclosure are possible in addition to the embodiments disclosed herein.

What is claimed is:

1. A fuel supply device for a gas turbine, comprising:

a fuel supply pipe in which fuel flows, the fuel supply pipe defining a central axis;

a first perforated plate disposed around the fuel supply pipe and formed with a first plurality of openings;

a fuel injection unit having a plurality of fuel injection pipes connected to the fuel supply pipe, the plurality of fuel injection pipes being radially arranged around the fuel supply pipe, each of the plurality of fuel injection pipes being formed in a cylindrical shape;

a second perforated plate disposed around the fuel supply pipe and formed with a second plurality of openings;

a third perforated plate disposed around the fuel supply pipe and formed with a third plurality of openings; and a cover accommodator, the cover accommodator defining a central axis that is the same axis as the fuel supply pipe central axis, the cover accommodator extending along the fuel supply pipe central axis, and the cover accommodator accommodating the first perforated plate, the third perforated plate, the fuel injection unit, and the second perforated plate therein, wherein the first perforated plate, the third perforated plate, the fuel injection unit and the second perforated plate are spaced apart and positioned from upstream to downstream in the recited order.

2. The fuel supply device according to claim 1, wherein the first plurality of openings have different diameters than each other and the second plurality of openings have different diameters each other.

3. The fuel supply device according, to claim 1, wherein each of the fuel injection pipes is formed with at least one fuel injection hole.

4. The fuel supply device according to claim 1, wherein the second plurality of openings are each inclined in a thickness direction of the second perforated plate.

5. The fuel supply device according to claim 1, wherein the second plurality of openings are each inclined in a radial direction of the second perforated plate.

6. The fuel supply device according to claim 1, wherein the second plurality of openings are each inclined in a tangential direction of the second perforated plate.

7. The fuel supply device according, to claim 1, wherein the cover accommodator has a fourth plurality of openings formed in a downstream portion of the cover accommodator.

8. The fuel supply device according to claim 7, wherein the fourth plurality of openings have different diameters than each other.

9. The fuel supply device according to claim 1, wherein the cover accommodator has a cylindrical shape.

10. A gas turbine comprising:

a compressor to compress air introduced thereinto;

a combustor to mix compressed air supplied from the compressor with fuel for combustion; and a turbine rotated by gas combusted in the combustor to generate power, wherein the combustor comprises a combustion chamber and at least one fuel nozzle mounted in the combustion chamber, wherein the fuel nozzle comprises:

the fuel supply device of claim 1.

* * * * *